US005196051A

United States Patent [19]

Heaslip et al.

[11] Patent Number: 5,196,051

[45] Date of Patent: Mar. 23, 1993

[54] LADLE AND METHOD FOR DRAINING LIQUID METAL WITH IMPROVED YIELD

[75] Inventors: Lawrence J. Heaslip, West Hill; James D. Dorricott, Burlington, both of Canada

[73] Assignee: Premier Refractories and Chemicals Inc., King of Prussia, Pa.

[21] Appl. No.: 732,595

[22] Filed: Jul. 19, 1991

[51] Int. Cl.[5] ..... B22D 41/02

[52] U.S. Cl. ..... 75/582; 266/227; 266/275

[58] Field of Search ..... 75/582; 266/227, 229, 266/230, 275; 164/335, 337

[56] References Cited

U.S. PATENT DOCUMENTS 3,516,478 6/1970 Dunn et al. ..... 266/227

4,746,102 5/1988 Gilles et al. ..... 266/275

*Primary Examiner*—Scott Kastler

*Attorney, Agent, or Firm*—Ostrolenk, Faber, Gerb & Soffen

[57] ABSTRACT

A ladle for housing and transferring liquid metal includes an outlet for the liquid metal and a ladle bottom. The ladle bottom has a surface adapted to be in contact with the liquid metal and an outlet nozzle formed in the surface adapted to be in fluid communication with the outlet of the ladle. The ladle bottom surface includes means to substantially prevent the entrainment of undesirable matter in liquid metal exiting said ladle.

59 Claims, 5 Drawing Sheets

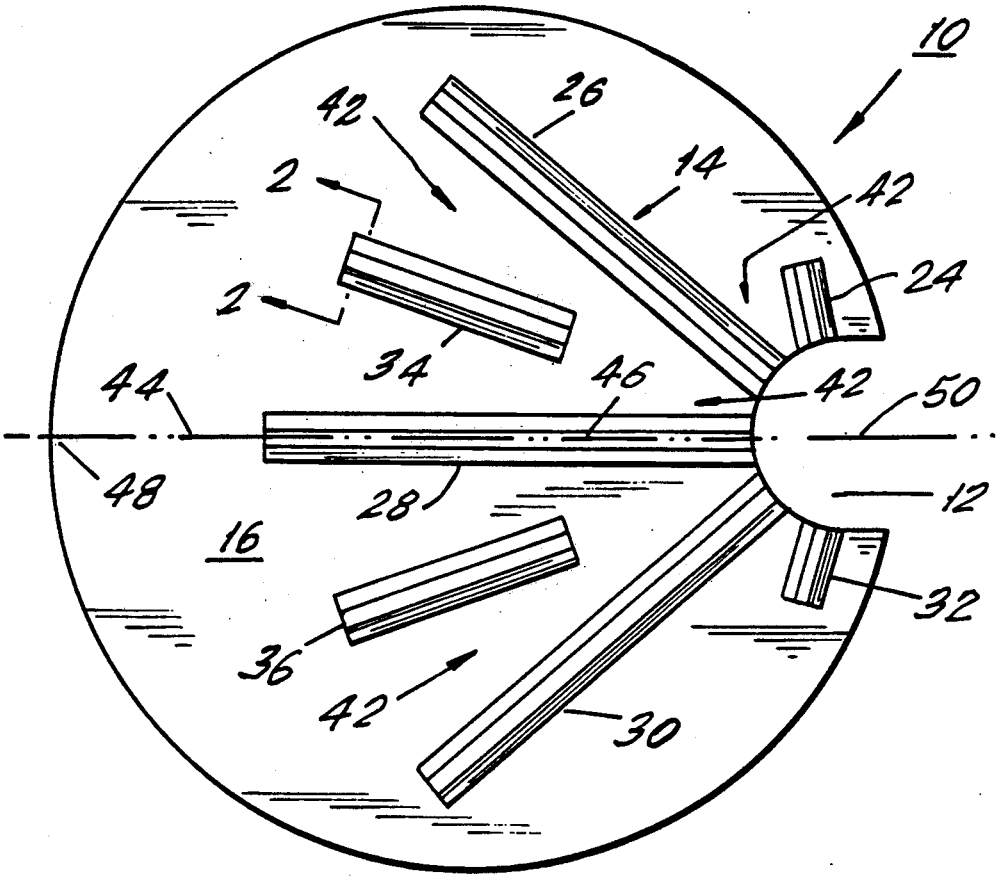
FIG. 1.
FIG. 6.
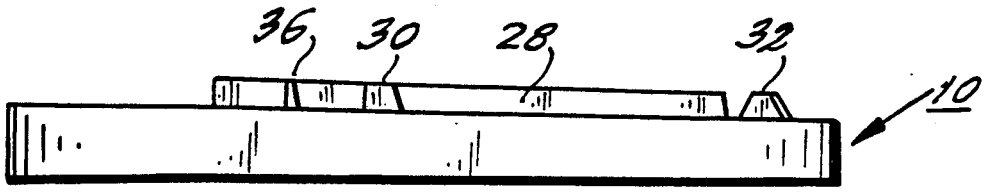

FIG. 10
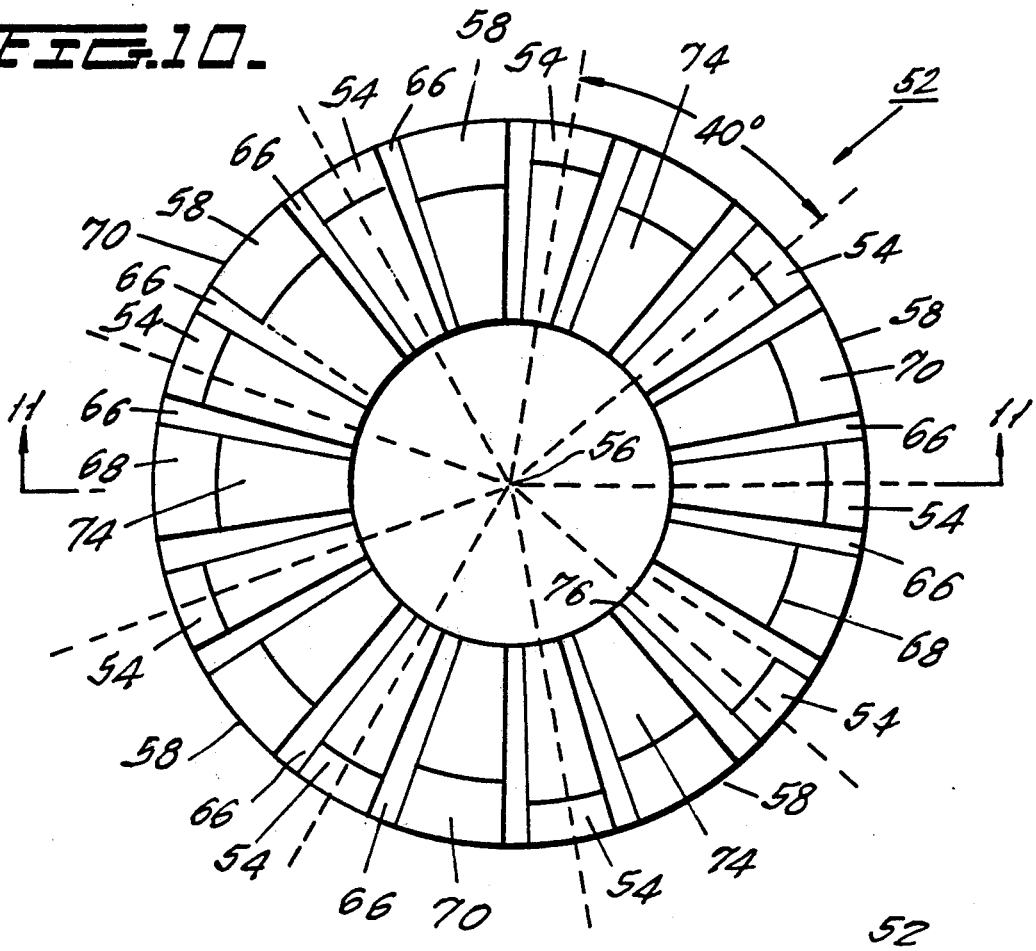
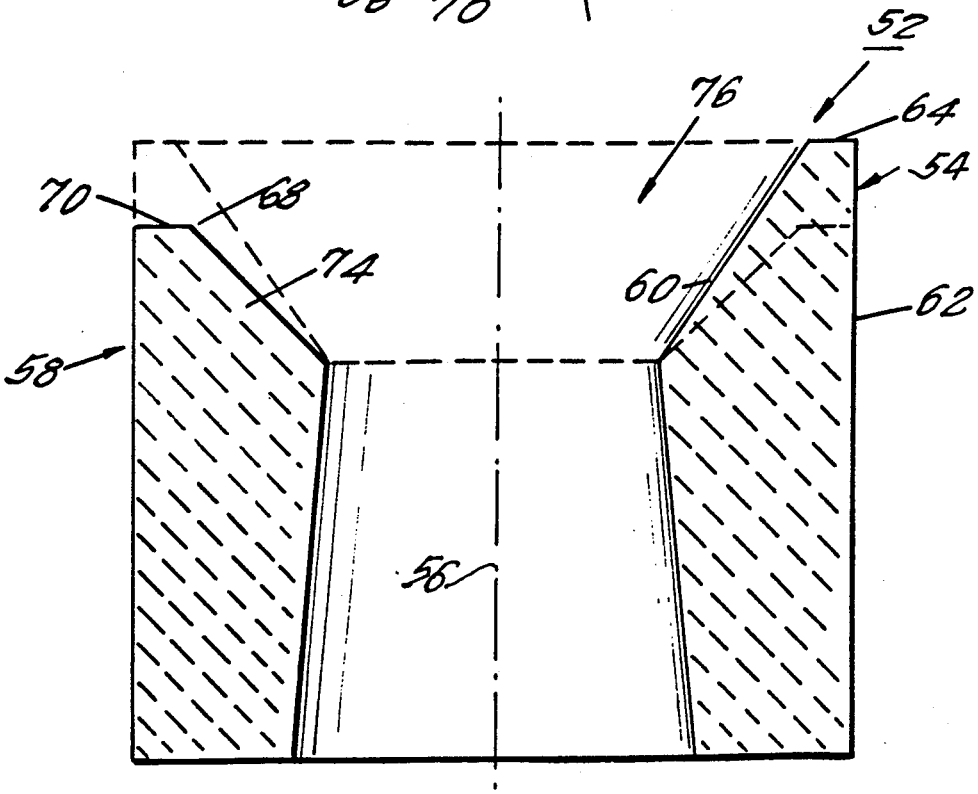
FIG. 11

LADLE AND METHOD FOR DRAINING LIQUID METAL WITH IMPROVED YIELD

BACKGROUND OF THE INVENTION

The present invention relates to a ladle for transferring liquid metal and more particularly to a ladle bottom and a method for using the ladle to eliminate slag so that a higher yield of liquid metal is obtained.

During refinement of molten or liquid metal, such as liquid steel, liquid metal is drained from a ladle, normally through a single outlet hole or outlet nozzle located in the bottom of the ladle, and into an intermediate vessel, called a tundish, or directly into a mold. During this process it is important to completely empty the ladle of metal without the introduction of slag into the tundish or mold. Slag contains undesirable elements which are produced during the refining of liquid metal. Slag floats on the surface of the liquid metal, but during transfer between holding vessels it becomes entrained with the liquid metal. If slag is detected exiting the ladle before the completion of metal drainage, the metal remaining in the ladle is considered lost yield. Therefore it is important to control the amount of slag which is transferred from the ladle to the tundish, or directly to the mold.

A ladle is generally fabricated from steel and lined with refractory materials. The prior art discloses simple refractory hot-face geometries consisting of generally cylindrical refractory sidewalls which include a taper from top to bottom with the bottom diameter being slightly smaller than the top. The term "hot-face" as used herein means the face of the ladle which is in direct contact with the liquid metal in the ladle. Ladle bottoms are normally fashioned from refractory brick or monolithic materials with a flat, stepped, or dish-shaped hot-face geometry.

U.S. Pat. No. 3,695,604 discloses a refractory lining for a sloped floor of a metallurgical vessel having an outlet orifice. The floor is divided into a plurality of sectors and consists of brick and wedge-shaped brick which radiate from the center of the outlet. U.S. Pat. No. 4,079,868 provides dissimilar grooves formed in the sidewalls of a refractory tundish nozzle.

Problems associated with the prior art ladles include slag carry over and entrainment into the liquid metal outlet stream resulting in contamination of the metal in the tundish or mold; the formation of vortexes during drainage which causes the slag to be entrained with the metal in the outlet flow; incomplete metal drainage; and metal penetration into the mortar joints between the bricks and joints and between the bottom and sidewalls.

SUMMARY OF THE INVENTION

Accordingly, it is an object of the present invention to provide a ladle including a ladle bottom and method for draining liquid metal to prevent entrainment of slag in liquid metal whereby complete metal drainage can be accomplished.

Another object is to provide such a ladle and refractory ladle bottom and method to alter the liquid metal flow behavior in a manner which improves slag/metal separation.

A further object is to provide such a ladle and refractory ladle bottom and method which allows liquid metal to flow in a consistent matter to the outlet nozzle, and minimizes the entrainment of the slag in the liquid metal while entrapping the slag in the ladle.

It is also an object to provide such a ladle and refractory ladle bottom and method to promote a symmetric flow of molten metal towards the outlet nozzle, thereby inhibiting the formation of vortexes.

It is another object to provide such a ladle and refractory ladle bottom and method to promote a maximum liquid metal depth above the outlet nozzle throughout the final period of draining to maximize the yield of liquid metal.

It is a further object to provide such a ladle and refractory ladle bottom and method which allows for ease of installation and repair of the refractory lining.

It has now been found that the above and other objects of the present invention are attained in a ladle for housing and transferring liquid metal. The ladle includes an outlet for the liquid metal and a ladle bottom. The ladle bottom has a surface adapted to be in contact with the liquid metal and an outlet nozzle formed in the surface adapted to be in fluid communication with the outlet of the ladle. The ladle bottom surface includes means to substantially prevent the entrainment of undesirable matter in liquid metal exiting the ladle.

In a preferred embodiment, the means to substantially prevent entrainment includes means to substantially entrap the undesirable matter on the ladle bottom surface. Preferably, the means to prevent entrainment includes means to substantially promote a symmetric flow of the liquid metal in a direction towards the outlet nozzle. Typically, the undesirable matter is slag and the ladle bottom is made up of a refractory material.

In a preferred embodiment, the means to prevent entrainment includes elongate castellations that approach the outlet nozzle to form a first channel therebetween that narrows as the castellations approach the outlet nozzle. The channel is in fluid communication with the outlet nozzle. The castellations extend radially outwardly from the outlet nozzle and converge upon a central line of symmetry of the outlet nozzle. The central line of symmetry joins the geometric center of the ladle bottom, or a point on the ladle bottom furthest from the outlet nozzle, to the geometric center of the outlet nozzle.

Preferably, the castellations have a minimum height of approximately 2% of the mean diameter of the ladle bottom and a maximum height of approximately 5%, and the castellations have a height to average width ratio approximately less than 2 and greater than 0.5.

In a preferred embodiment, each of the castellations has a top width and a bottom width, and the cross-sectional shape of the castellations is substantially in the form of a trapezoid, wherein the bottom width is greater than the top width.

In an alternative embodiment, the bottom width is equal to the top width, or the cross-sectional shape of the castellations is substantially in the form of a semicircle, or in the form of a triangle.

Preferably, the castellations include a first set of castellations and a second set of castellations. The first set of castellations includes a castellation located along the central line of symmetry of the outlet nozzle. The first set of castellations substantially approach the outlet nozzle and include castellations located at about 30 degree to 50 degree intervals from the central line of symmetry of the outlet nozzle. In a preferred embodiment, the first set of castellations include castellations located at about 40 degree intervals from the central line of symmetry of the outlet nozzle.

Preferably, the second set of castellations are spaced from the outlet nozzle and are located between the first set of castellations. The second set of castellations are spaced from the outlet nozzle and are located at about 20 degree intervals from the central line of symmetry.

In a preferred embodiment, elevation of the surface of the ladle bottom is reduced continuously along the central line of symmetry towards the outlet nozzle. Preferably, the outlet nozzle is not centrally located on the ladle bottom surface.

In an alternate embodiment, the outlet nozzle is centrally located on the ladle bottom surface, and the first set of castellations are positioned at about 45 degree intervals, and the second set of castellations are positioned therebetween.

Preferably, the means to prevent entrainment further includes a nozzle block insert adapted to be received in the outlet nozzle. The nozzle block insert has a central opening and a third set of castellations that extend radially outwardly from the central opening and are substantially aligned with the first set of castellations.

In a preferred embodiment, the third set of castellations form a second channel therebetween in fluid communication with the first channel and the central opening. Preferably, the second channel includes a bottom. The bottom includes a flat base portion extending from the periphery of the nozzle block insert, and an inner angled wall angularly extending from the flat base portion towards the central opening.

Preferably, each of the third set of castellations includes a flat top portion extending from the periphery of the nozzle block insert, an inner wall angularly extending from the top portion towards the central opening, a flat rear wall extending down from the top portion, and angled side walls which extend to the bottom of the second channel from opposite sides of the top portion and the inner wall.

In a preferred embodiment, a ladle bottom adapted to be used in combination with a ladle for housing and transferring liquid metal has an outlet for the liquid metal. The ladle bottom includes a surface adapted to be in contact with the liquid metal and an outlet nozzle formed in the ladle bottom surface adapted to be in fluid connection with the outlet of the ladle. The ladle bottom surface includes means to substantially prevent the entrainment of undesirable matter in liquid metal exiting the ladle.

Preferably, the means to substantially prevent entrainment includes means to substantially entrap the undesirable matter on the ladle bottom surface and means to substantially promote a symmetric flow of the liquid metal in a direction towards the outlet nozzle.

In a preferred embodiment, a method of improving the yield of liquid metal drained from a ladle includes the steps of adding the liquid metal to the ladle. The ladle includes an outlet for the liquid metal and a ladle bottom. The ladle bottom has a surface adapted to be in contact with the liquid metal and an outlet nozzle formed in the ladle bottom surface adapted to be in fluid communication with the outlet of the ladle. Next, a symmetric flow of the liquid metal is promoted in a direction towards the outlet nozzle. Slag is prevented from being entrained in the liquid metal that exits the ladle. Then, the liquid metal is drained from the ladle through the outlet nozzle and the ladle outlet.

Preferably, the method includes the further step of entrapping slag on the ladle bottom surface.

Other objects, features and advantages of the present invention will become apparent from the following description of the invention which refers to the accompanying drawings.

BRIEF DESCRIPTION OF THE DRAWINGS

For the purpose of illustrating the invention, there is shown in the drawings an embodiment which is presently preferred; it being understood, however, that the invention is not limited to the precise arrangements and instrumentalities shown.

FIG. 1 is a top plan view of a ladle bottom of the present invention.

FIG. 6 is a side elevation view of the ladle bottom of FIG. 1.

FIG. 10 is a top plan view of a nozzle block insert for use with the ladle bottom of FIG. 1.

FIG. 11 is a cross-sectional view of the nozzle block insert of FIG. 10 taken along line 11—11 of FIG. 10.

DETAILED DESCRIPTION OF A PREFERRED EMBODIMENT

Figure 2:
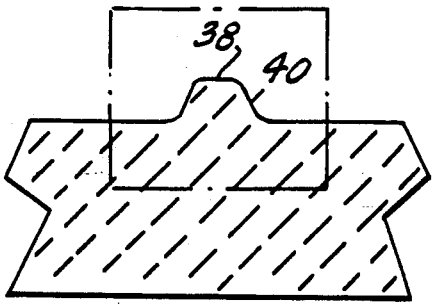
FIG. 2 is a cross-sectional view of a single castellation protruding from the ladle bottom taken along line 2—2 of FIG. 1.

Referring now to the drawings wherein like numerals indicate like elements, there is shown in FIG. 1 a ladle bottom 10. Preferably, the ladle bottom 10 is manufactured using refractory materials, or any other materials having like properties.

The ladle bottom 10 is designed to sit on the floor of a steel making ladle, not shown. The ladle bottom 10 includes a typical off-center outlet nozzle 12, which is in fluid communication with the outlet of the ladle, not shown. The ladle bottom 10 incorporates a plurality of elongate castellations 14 that extend towards the outlet nozzle 12 in the geometry of a refractory hot face surface 16. As noted above, the refractory hot face is the face of the ladle in contact with the molten metal.

Figure 2A:
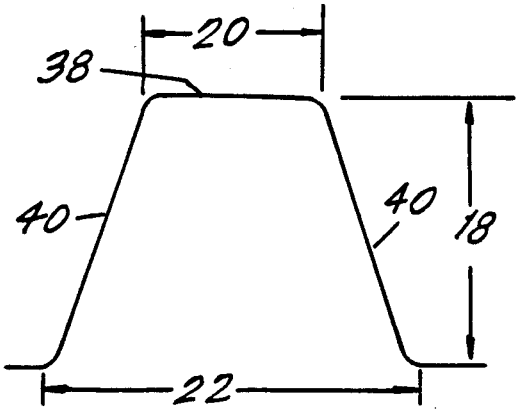
FIG. 2A is an enlarged view of the featured section of the castellation of FIG. 2.
Figure 3:
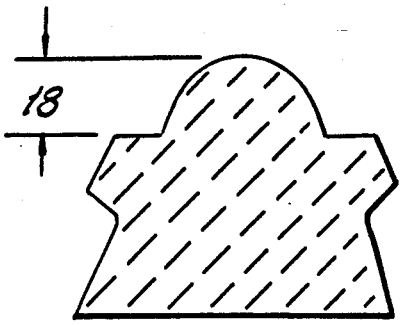
FIGS. 3, 4 and 5 are cross-sectional views of alternative cross-sectional shapes of the castellations.
Figure 4:
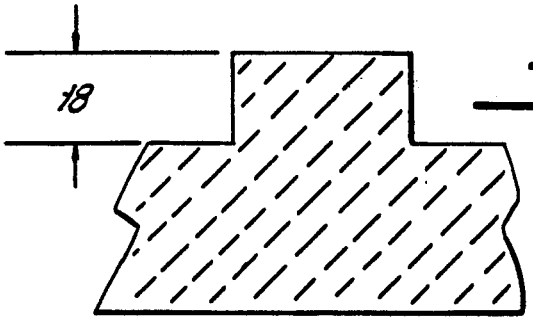
Figure 5:
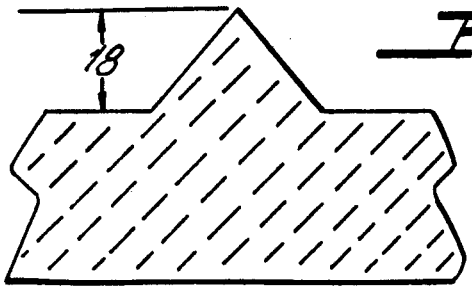
Figure 7:
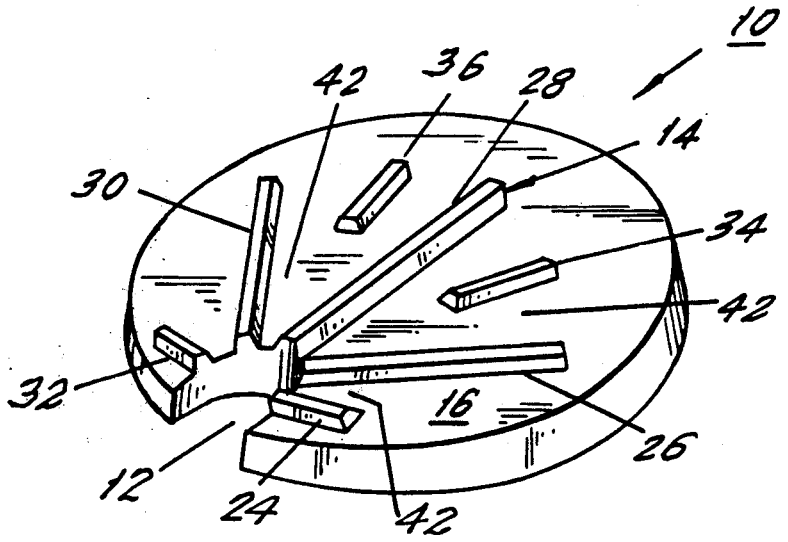
FIG. 7 is a perspective view of the ladle bottom of FIG. 1.

The castellations 14 can be of a number of cross-sectional designs, examples of which are illustrated in FIGS. 2-5. In FIGS. 2 and 2A, a castellation 34 is shown to have a trapezoidal cross-sectional design.

The critical dimensions of the castellations 14 are their height 18, and their height to average width ratio. Preferably, the height to average width ratio of the castellations 14 is less than 2 but greater than 0.5.

The height 18 of the castellations 14 is calculated as a function of the mean diameter of the ladle bottom 10. Each castellation 14 should have a minimum height 18 of 2% of the mean diameter of the ladle bottom 10 and a maximum height 18 of 5%. Each castellation 14 may over its entire length vary its height and width according to these limitations.

Referring now to FIG. 2, the average width of the castellations 14, e.g. castellation 34, is calculated by adding the width 20 at the top of the castellation 34, with the width 22 at the bottom of the castellation 34, and dividing this number in half. The average width of the alternative castellations of FIGS. 3-5 can be similarly calculated using readily known geometric formulae.

As shown in FIG. 1, the surface 16 of the ladle bottom 10 includes a plurality of the castellations 14, 24-32 and 36 in addition to the castellation 34, extending radially outwardly from the outlet nozzle 12. Each of the castellations 24-36 has a trapezoidal cross-sectional design. As can be seen from FIG. 2a, each of the castellations 24-36 includes a top 38 extending generally parallel to the surface 16, and a pair of side walls 40 angularly extending to the surface 16.

The castellations 24-32 are referred to as major castellations and are defined by their substantial approach to the outlet nozzle 12. The major castellations 24-32 form channels 42 therebetween which narrow as they approach the outlet nozzle 12. The castellations 34 and 36 are referred to as minor castellations and differ from the major castellations in that they are spaced from, and do not substantially approach, the outlet nozzle 12. The minor castellations 34 and 36 also form channels 42 with the adjacent major castellations 26-30.

As shown in FIG. 1, it is preferable, but not required, that at least one major castellation 28 is located along a line 44, which is a central line of symmetry in the arrangement of the castellations 14. The remaining castellations 24, 26 and 30, 32 are symmetrically arranged to converge upon the central line of symmetry 44 at about 30-50 degree intervals from the line of symmetry 44. For example, in the embodiment of FIG. 1, the major castellations 24, 26 and 30, 32 are arranged in a symmetrical pattern at about 40 degree intervals from the line of symmetry 44 and the major castellation 28.

The symmetrical orientation of the castellations 24-36 produces a symmetry in the liquid metal flow (a symmetric flow of liquid metal), towards the outlet nozzle 12 during drainage which aligns the flow of the liquid metal in a direction towards the outlet nozzle 12 and through the channels 42 and inhibits the formation of a draining vortex.

The line of symmetry 44 should join the geometric center 46 of the ladle bottom 10 or a point 48 on the ladle bottom 10 circumference furthest from the outlet nozzle 12, to the geometric center 50 of the outlet nozzle 12. In certain geometries, there may be more than one line of symmetry 44. For example, in the case of an oval ladle where the geometric center of the outlet nozzle and the geometric center of the ladle bottom and the point on the perimeter of the ladle bottom farthest from the center of the nozzle may not be colinear, the ladle has two lines of symmetry; one joining the outlet nozzle center and the ladle center and the other joining the outlet nozzle center and the farthest point. In such a case, either line of symmetry may be chosen as the line of symmetry for the castellations.

The minor castellations 34 and 36 are located between the major castellations 24-32 at equal intervals from the line of symmetry 44. In FIG. 1 where the major castellations 24, 26 and 30, 32 are arranged at 40 degree intervals, the minor castellations 34, 36 are arranged at 20 degree intervals from the line of symmetry 44.

Referring to FIGS. 10 and 11, the outlet nozzle 12 includes a nozzle block insert 52 adapted to be received in the outlet nozzle 12. The nozzle block insert 52 has a plurality of radial castellations 54 arranged in a symmetric pattern about a center line 56 of the nozzle block insert 52. The castellations 54 are adapted to be substantially aligned with the major castellations 24-32 of the ladle bottom 10 and form channels 58 between adjacent castellations 54 which are in fluid communication with the channels 42 in the ladle bottom 10 to receive liquid metal therefrom. The nozzle block insert 52 is held in place in the outlet nozzle 12 using a plastic or ramming refractory material. Such refractory material serves the additional purpose of filling in any gaps between the nozzle block insert 52 and the wall of the ladle bottom 10 defining the outlet nozzle 12.

Each castellation 54 of the nozzle block insert 52 has an angled inner wall 60, a flat rear wall 62, a top portion 64 and angled side walls 66 which extend to a base 68 of the channels 58. The base 68 includes a flat portion 70, and an inner angled wall 74. Each top portion 64 and each flat portion 70 extends from the periphery of the nozzle block insert 52 to the inner angled wall 60 and the inner angled wall 74, respectively, and then to a central opening 76 in the nozzle block insert 52 through which liquid metal passing through the channels 42 and 58 exits the outlet nozzle 12.

The outlet nozzle 12 includes a separate nozzle block insert 52 because the outlet nozzle 12 is the portion of the ladle bottom 10 that suffers the most degradation during use and, therefore, must be frequently replaced. In particular, the outlet nozzle 12 is frequently cleaned by burning after use to remove solidified metal. Such burning, after a period of time, serves to degrade the outlet nozzle 12 to a point where it is no longer usable and must be replaced. The use of a separate nozzle block insert 52 enables such replacement to be effected by knocking out the spent nozzle block and inserting a new one.

The interval between the major castellations 24-32 is dependent upon the diameter of the nozzle block insert 52 and the width of the castellations 24-32 at the point of closest approach to the nozzle block insert 52. These dimensions should be adjusted to avoid the merger of adjacent castellations which will close off the channels therebetween.

As illustrated in FIG. 6, it is preferable that the elevation of the ladle bottom 10 be reduced continuously along the line of symmetry 44 towards the outlet nozzle 12. The elevation of each half of the ladle bottom 10 (divided by the line of symmetry 44) can also be reduced continually along a line normal to the line of symmetry 44. The ladle bottom 10 can be manufactured with such a slope by any of the known methods.

In use, the castellations 14, 54 of the ladle bottom 10 promote a symmetric flow of the liquid metal (aligns the flow of the liquid metal) in a direction towards the outlet nozzle 12, and trap slag, and inhibit vortex formation, thereby, improving the yield of liquid metal from the ladle 10 to the tundish or molds. The castellations 14, 54 separate slag from the liquid metal as it flows towards the outlet nozzle 12 and exits the outlet nozzle 12 through the central opening 76 of the nozzle block insert 52. As the liquid metal symmetrically flows towards the outlet nozzle 12, and through the channels 42, 58, slag floating on the surface of the liquid metal is entrapped between the castellations 14, 54 where the channels 42, 58 narrow to the point where the particles of slag are too large to pass therethrough. The castellations 14, 54 also cause slag to be deposited on the tops and sides of the castellations 14, 54. As a result, the liquid metal exiting the ladle and into a tundish or mold is free of slag.

The change in elevation across the ladle bottom 10 also contributes to maximizing the yield of liquid metal from the ladle. The change in elevation promotes a maximum liquid metal depth above the outlet nozzle 12 throughout the final period of draining. This is because the ladle bottom 10 is on an angle with the lowest point—the outlet nozzle 12. Therefore the liquid metal flows towards the outlet nozzle 12 including the nozzle block insert 52 and is trapped by the castellations 14, 54 situated around the outlet nozzle 12 and the nozzle block insert 52.

Figure 8A:
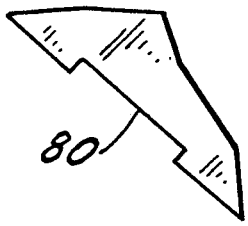
FIG. 8A is an enlarged broken away view of the featured section of FIG. 8.
Figure 8:
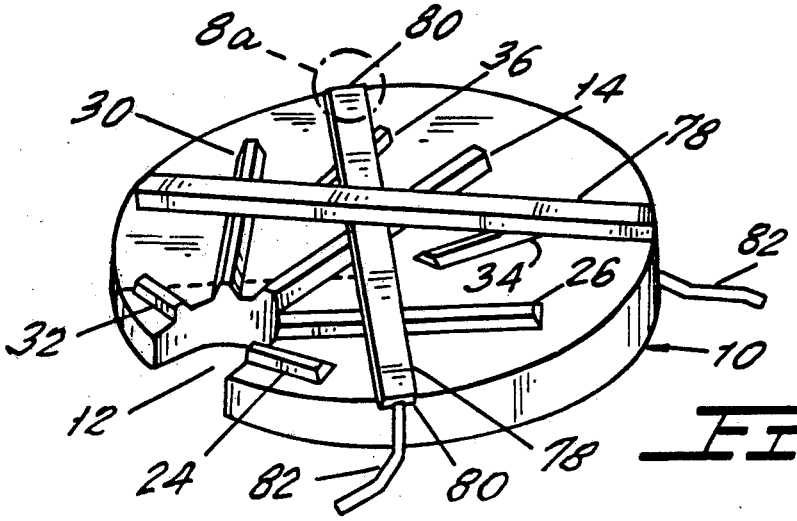
FIG. 8 is a perspective view of the ladle bottom of FIG. 7 with attachment means for transport.

Referring now to FIGS. 8 and 8*a*, the ladle bottom 10 can be easily transported by attaching two wood planks 78 across the surface 16 of the ladle bottom 10, preferably being perpendicular to each other, and then placing the ends of the wood planks 78 within notches 80 on the side where the wood planks 78 reach the edge of the ladle bottom 10. A band 82 is then placed from the notches 80 to beneath the ladle bottom 10. The ladle bottom 10 can thus be transported.

Figure 9:
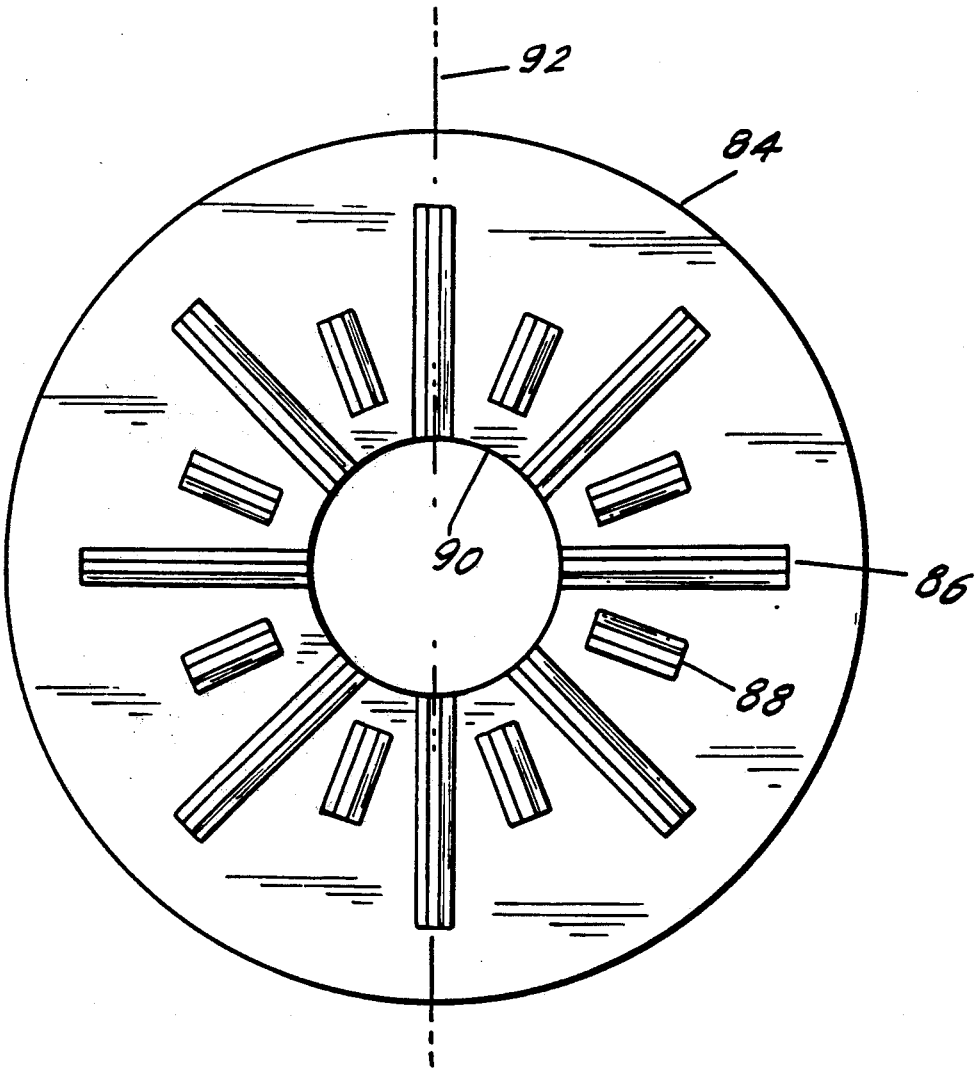
FIG. 9 is a top plan view of an alternative embodiment of the ladle bottom of the present invention.

Referring now to FIG. 9, there is illustrated a ladle bottom 84 which is an alternative embodiment of the ladle bottom 10. In this type of arrangement, major castellations 86 and minor castellations 88 encircle a centrally located outlet nozzle 90 and extend radially outwardly from the outlet nozzle 90. The major castellations 86 are at about 45 degree angles from adjacent major castellations, while the minor castellations 88 are placed therebetween. At least one major constellation is located along a line 92 which is a central line of symmetry in the arrangement of the castellations 86 and 88. It is preferable that the elevation of the ladle bottom 10 be reduced continuously towards the outlet nozzle 90.

A nozzle block insert, similar to the nozzle block insert 52, can be included within the outlet nozzle 90. The castellations of the nozzle block insert would need to be adapted to be substantially aligned with the major castellations 86.

The ladle and refractory ladle bottom and method for draining liquid metal of the present invention prevents entrainment of slag in liquid metal whereby complete metal drainage can be accomplished. The liquid metal flow behavior is altered in a manner which improves slag/metal separation.

The liquid metal is allowed to flow in a consistent manner to the outlet nozzle, and minimizes the entrainment of the slag in the liquid metal while entrapping the slag in the ladle. The ladle promotes a symmetric flow of molten metal towards the outlet nozzle, thereby, inhibiting the formation of vortexes. It also promotes a maximum liquid metal depth above the outlet nozzle through the final period of draining to maximize the yield of liquid metal. The ladle and method allow for ease of installation and repair of the refractory lining.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A ladle for housing and transferring liquid metal, said ladle comprising an outlet for said liquid metal and a ladle bottom, said ladle bottom having a surface adapted to be in contact with said liquid metal, and an outlet nozzle formed in said ladle bottom surface adapted to be in fluid communication with said outlet of said ladle, said ladle bottom surface including means for substantially preventing the entrainment of undesirable matter in liquid metal exiting said ladle, said means including means for substantially entrapping said undesirable matter on said ladle bottom surface.

2. The ladle of claim 1 wherein said means includes means for promoting a substantially symmetric flow of said liquid metal in a direction towards said outlet nozzle.

3. The ladle bottom of claim 1 wherein said ladle bottom is made up of a refractory material.

4. The ladle of claim 1 wherein said means includes elongate castellations that approach said outlet nozzle to form a first channel therebetween that narrows as said castellations extend further towards said outlet nozzle, said channel being in fluid communication with said outlet nozzle.

5. The ladle of claim 4 wherein said castellations extend radially outwardly from said outlet nozzle and converge upon a central line of symmetry of said outlet nozzle.

6. The ladle of claim 5 wherein said central line of symmetry joins the geometric center of said ladle bottom, or a point on said ladle bottom furthest from said outlet nozzle, to the geometric center of said outlet nozzle.

7. The ladle of claim 5 wherein said castellations have a minimum height of approximately 2% of the mean diameter of said ladle bottom and a maximum height of approximately 5%.

8. The ladle of claim 5 wherein said castellations have a height to average width ratio approximately less than 2 and greater than 0.5.

9. The ladle of claim 5 wherein the bottom width of said castellations is greater than the top width of said castellations.

10. The ladle of claim 9 wherein the bottom width of said castellations is equal to the top width of said castellations.

11. The ladle of claim 5 wherein the cross-sectional shape of said castellations is substantially in the form of a trapezoid.

12. The ladle of claim 5 wherein the cross-sectional shape of said castellations is substantially in the form of a semicircle.

13. The ladle of claim 5 wherein the cross-sectional shape of said castellations is substantially in the form of a triangle.

14. The ladle of claim 5 wherein the castellations include a first set of castellations and a second set of castellations.

15. The ladle of claim 14 wherein said first set of castellations includes a castellation located along said central line of symmetry of said outlet nozzle.

16. The ladle of claim 14 wherein said first set of castellations substantially approach said outlet nozzle and include castellations located at about 30 degree to 50 degree intervals from said central line of symmetry of said outlet nozzle.

17. The ladle of claim 16 wherein said first set of castellations include castellations located at about 40 degree intervals from said central line of symmetry of said outlet nozzle.

18. The ladle of claim 15 wherein said second set of castellations are spaced from said outlet nozzle and are located between said first set of castellations.

19. The ladle of claim 18 wherein said second set of castellations include castellations that are spaced from said outlet nozzle and are located at about 20 degree intervals from said central line of symmetry.

20. The ladle of claim 5 wherein the elevation of said surface of said ladle bottom is reduced continuously along said central line of symmetry towards said outlet nozzle.

21. The ladle of claim 4 wherein said outlet nozzle is not centrally located on said ladle bottom surface.

22. The ladle of claim 14 wherein said outlet nozzle is centrally located on said ladle bottom surface.

23. The ladle of claim 22 wherein said first set of castellations include castellations that are positioned at about 45 degree intervals, and said second set of castellations are positioned therebetween.

24. The ladle of claim 5 wherein said means further includes a nozzle block insert adapted to be received in said outlet nozzle, said nozzle block insert having a central opening and a third set of castellations that extend radially outwardly from said central opening and that are substantially aligned with said first set of castellations.

25. The ladle of claim 24 wherein said third set of castellations form a second channel therebetween in fluid communication with said first channel and said central opening.

26. The ladle bottom of claim 25 wherein said second channel includes a bottom, said bottom including a flat base portion extending from the periphery of said nozzle block insert, and an inner angled wall angularly extending from said flat base portion towards said central opening.

27. The ladle bottom of claim 27 wherein said third set of castellations include castellations having a flat top portion extending from the periphery of said nozzle block insert, an inner wall angularly extending from said top portion towards said central opening, a flat rear wall extending down from said top portion, and angled side walls which extend to said bottom of said second channel from opposite sides of said top portion and said inner wall.

28. A ladle bottom adapted to be used in combination with a ladle for housing and transferring liquid metal and having an outlet for said liquid metal, said ladle bottom comprising a surface adapted to be in contact with said liquid metal and an outlet nozzle formed in said ladle bottom surface adapted to be in fluid connection with said outlet of said ladle, said ladle bottom surface including means for substantially preventing the entrainment of undesirable matter in liquid metal exiting said ladle, said means including means for substantially entrapping said undesirable matter on said ladle bottom surface.

29. The ladle bottom of claim 28 wherein said means includes means for promoting a substantially symmetric flow of said liquid metal in a direction towards said outlet nozzle.

30. A method of improving the yield of liquid metal drained from a ladle comprising the steps of:

adding said liquid metal to said ladle, said ladle including an outlet for said liquid metal and a ladle bottom, said ladle bottom having a surface adapted to be in contact with said liquid metal and an outlet nozzle formed in said ladle bottom surface adapted to be in fluid communication with said outlet of said ladle;

promoting a symmetric flow of said liquid metal in a direction towards said outlet nozzle;

preventing the entrainment of slag in liquid metal that exits said ladle by entrapping said slag on said ladle bottom surface; and draining said liquid metal from said ladle through said outlet nozzle and said outlet of said ladle.

31. The ladle of claim 4 wherein each of said castellations includes a central line of symmetry and wherein the elevation of said surface of said ladle bottom is reduced continuously along each said central line of symmetry towards said outlet nozzle.

32. The ladle of claim 5 wherein the elevation of said surface of said ladle bottom is reduced continuously towards said central line of symmetry.

33. The ladle bottom of claim 28 wherein said ladle bottom is made up of a refractory material.

34. The ladle bottom of claim 28 wherein said means further includes elongate castellations that approach said outlet nozzle to form a first channel therebetween that narrows as said castellations extend further towards said outlet nozzle, said channel being in fluid communication with said outlet nozzle.

35. The ladle bottom of claim 34 wherein said castellations extend radially outwardly from said outlet nozzle and converge upon a central line of symmetry of said outlet nozzle.

36. The ladle bottom of claim 35 wherein said central line of symmetry joins the geometric center of said ladle bottom, or a point on said ladle bottom furthest from said outlet nozzle, to the geometric center of said outlet nozzle.

37. The ladle bottom of claim 35 wherein said castellations have a minimum height of approximately 2% of the mean diameter of said ladle bottom and a maximum of height of approximately 5%.

38. The ladle bottom of claim 35 wherein said castellations have a height to average width ratio approximately less than 2 and greater than 0.5.

39. The ladle bottom of claim 35 wherein said castellations include a first set of castellations and a second set of castellations.

40. The ladle bottom of claim 39 wherein said first set of castellations include a castellation located along said central line of symmetry of said outlet nozzle.

41. The ladle bottom of claim 39 wherein said first set of castellations substantially approach said outlet nozzle and include castellations located at about 30 degree to 50 degree intervals from said central line of symmetry of said outlet nozzle.

42. The ladle bottom of claim 41 wherein said first set of castellations include castellations located at about 40 degree intervals from said central line of symmetry of said outlet nozzle.

43. The ladle bottom of claim 40 wherein said second set of castellations are spaced from said outlet nozzle and are located between said first set of castellations.

44. The ladle bottom of claim 43 wherein said second set of castellations include castellations that are spaced from said outlet nozzle and are located at about 20 degree intervals from said central line of symmetry.

45. The ladle bottom of claim 35 wherein the elevation of said surface of said ladle bottom is reduced continuously along said central line of symmetry towards said outlet nozzle.

46. The ladle bottom of claim 34 wherein each of said castellations includes a central line of symmetry and wherein the elevation of said surface of said ladle bottom is reduced continuously along each said central line of symmetry towards said outlet nozzle.

47. The ladle bottom of claim 35 wherein the elevation of said surface of said ladle bottom is reduced continuously towards said central line of symmetry.

48. The ladle bottom of claim 34 wherein said outlet nozzle is not centrally located on said ladle bottom surface.

49. The ladle bottom of claim 39 wherein said outlet nozzle is centrally located on said ladle bottom surface.

50. The ladle bottom of claim 49 wherein said first set of castellations include castellations that are positioned at about 45 degree intervals, and said second set of castellations are positioned therebetween.

51. The ladle bottom of claim 34 wherein said means further includes a nozzle block insert adapted to be received in said outlet nozzle, said nozzle block insert having a central opening and a third set of castellations that extend radially outwardly from said central opening and that are substantially aligned with said first set of castellations.

52. The ladle bottom of claim 51 wherein said third set of castellations form a second channel therebetween in fluid communication with said first channel and said central opening.

53. The ladle bottom of claim 52 wherein said second channel includes a bottom, said bottom including a flat base portion extending from the periphery of said nozzle block insert, and an inner angled wall angularly extending from said flat base portion towards said central opening.

54. The ladle bottom of claim 51 wherein said third set of castellations include castellations having a flat top portion extending from the periphery of said nozzle block insert, an inner wall angularly extending from said top portion towards said central opening, a flat rear wall extending down from said top portion, and angled side walls which extend to said bottom of said second channel from opposite sides of said top portion of said inner wall.

55. A ladle bottom comprising:

a surface means adapted to be in contact with liquid metal;

an outlet orifice formed in said surface means for passing the liquid metal therethrough;

castellation means formed on said surface for substantially preventing the entrainment of undesirable matter in the liquid metal passing through said outlet orifice, said castellation means including elongate ribs that converge in a direction towards said outlet orifice to form a first channel in fluid communication with said outlet orifice.

56. The ladle bottom of claim 55 including means for substantially entrapping the undesirable matter on said surface means.

57. The ladle bottom of claim 55 including means for promoting a substantially symmetric flow of the liquid metal in a direction towards said outlet orifice.

58. The ladle bottom of claim 55 including means for substantially entrapping the undesirable matter within said first channel.

59. The ladle bottom of claim 55 including means for substantially entrapping the undesirable matter on said castellation means.

* * * * *